US007692673B2

(12) United States Patent
Shin

(10) Patent No.: US 7,692,673 B2
(45) **Date of Patent: *Apr. 6, 2010**

(54) DISPLAY DEVICE AND DEMULTIPLEXER

(75) Inventor: Dong-yong Shin, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1017 days.

This patent is subject to a terminal disclaimer.

(21) Appl. No.: 11/124,926

(22) Filed: May 9, 2005

(65) Prior Publication Data

US 2005/0259052 A1 Nov. 24, 2005

(30) Foreign Application Priority Data

May 15, 2004 (KR) ..... 10-2004-0034560

(51) Int. Cl.
*G09G 5/02* (2006.01)

(52) U.S. Cl. ..... 345/694

(58) Field of Classification Search ..... 345/87, 345/99, 100, 76, 77, 90, 204, 206, 208, 211, 345/104, 623; 370/536; 365/189.09; 702/189
See application file for complete search history.

(56) References Cited

U.S. PATENT DOCUMENTS 4,447,812 A * 5/1984 Soneda et al. ..... 345/98
5,426,447 A 6/1995 Lee
5,510,807 A 4/1996 Lee et al.
5,555,001 A 9/1996 Lee et al.
5,633,653 A * 5/1997 Atherton ..... 345/98
5,708,454 A 1/1998 Katoh et al.
5,892,493 A 4/1999 Enami et al.
6,097,362 A 8/2000 Kim (Continued)

FOREIGN PATENT DOCUMENTS

CN 1116454 A 2/1996

(Continued)

OTHER PUBLICATIONS

T. Kretz et al; "A 3.4-inch Reflective Colour Active Matrix Liquid Crystal Display without Polarisers"; SID 02 Digest, May 2002, pp. 798-801.

(Continued)

*Primary Examiner*—Prabodh M Dharia
(74) *Attorney, Agent, or Firm*—Christie, Parker & Hale, LLP

(57) ABSTRACT

A display device including plural pixels, plural scan lines for applying scan signals to the pixels, plural first data lines for transmitting first data currents to the pixels, a scan driver for outputting the scan signals, a demultiplexer including plural demultiplexing circuits for demultiplexing second data currents into the first data currents, and for transmitting the first data currents to the plural first data lines, and a data driver for transmitting the second data currents. A demultiplexing circuit demultiplexes one of the second data currents into at least two first data currents, and transmits them to at least two first data lines. The number of the at least two first data lines is an integer multiple of the number of sub-pixels in each pixel. A display device and a demultiplexer having a simple structure data driver, where a stationary pattern due to demultiplexing is reduced or eliminated, can be provided.

19 Claims, 7 Drawing Sheets

U.S. PATENT DOCUMENTS

| | | | | |
|---|---|---|---|---|
| 6,333,729 | B1 | 12/2001 | Ha | |
| 6,348,906 | B1 | 2/2002 | Dawson et al. | |
| 6,359,608 | B1 | 3/2002 | Lebrun et al. | |
| 6,559,836 | B1 | 5/2003 | Mori | |
| 6,667,580 | B2 | 12/2003 | Kim et al. | |
| 6,731,266 | B1 | 5/2004 | Jung | |
| 6,771,028 | B1 * | 8/2004 | Winters | 315/169.1 |
| 6,924,784 | B1 | 8/2005 | Yeo et al. | |
| 7,015,882 | B2 | 3/2006 | Yumoto | |
| 7,038,652 | B2 | 5/2006 | Kang et al. | |
| 7,180,497 | B2 | 2/2007 | Lee et al. | |
| 7,256,756 | B2 | 8/2007 | Abe | |
| 7,259,740 | B2 * | 8/2007 | Haga et al. | 345/98 |
| 7,310,092 | B2 | 12/2007 | Imamura | |
| 7,324,079 | B2 | 1/2008 | Tobita | |
| 7,342,559 | B2 * | 3/2008 | Shin | 345/76 |
| 7,403,176 | B2 | 7/2008 | Chung et al. | |
| 7,468,718 | B2 * | 12/2008 | Shin | 345/98 |
| 7,505,017 | B1 | 3/2009 | Yeo et al. | |
| 2003/0030602 | A1 | 2/2003 | Kasai | |
| 2003/0107561 | A1 | 6/2003 | Uchino et al. | |
| 2003/0132907 | A1 * | 7/2003 | Lee et al. | 345/98 |
| 2003/0179164 | A1 * | 9/2003 | Shin et al. | 345/76 |
| 2004/0032382 | A1 | 2/2004 | Cok et al. | |
| 2004/0056852 | A1 | 3/2004 | Shih et al. | |
| 2004/0227749 | A1 | 11/2004 | Kimura | |
| 2005/0030321 | A1 * | 2/2005 | Anwar | 345/629 |
| 2005/0052890 | A1 | 3/2005 | Morita | |
| 2005/0110727 | A1 * | 5/2005 | Shin | 345/76 |
| 2005/0116919 | A1 | 6/2005 | Shin | |
| 2005/0117611 | A1 | 6/2005 | Shin | |
| 2005/0264495 | A1 * | 12/2005 | Shin | 345/76 |
| 2005/0270257 | A1 * | 12/2005 | Shin | 345/76 |
| 2009/0174649 | A1 * | 7/2009 | Kim | 345/104 |

FOREIGN PATENT DOCUMENTS

| | | | |
|---|---|---|---|
| CN | 1301377 | A | 6/2001 |
| CN | 1417771 | A | 5/2003 |
| CN | 1432989 | A | 7/2003 |
| CN | 1447302 | A | 10/2003 |
| CN | 1488131 | | 4/2004 |
| GB | 2 384 102 | A | 7/2003 |
| JP | 02-306293 | | 12/1990 |
| JP | 06-118913 | | 4/1994 |
| JP | 2000-122607 | | 4/2000 |
| JP | 2000-356978 | | 12/2000 |
| JP | 2002-40961 | | 2/2002 |
| JP | 2002-351357 | | 12/2002 |
| JP | 2003-058108 | | 2/2003 |
| JP | 2003-76327 | | 3/2003 |
| JP | 2003-114645 | | 4/2003 |
| JP | 2003157048 | A * | 5/2003 |
| JP | 2003-177722 | | 6/2003 |
| JP | 2003-195812 | | 7/2003 |
| JP | 2003-195815 | | 7/2003 |
| JP | 2003-330386 | | 11/2003 |
| JP | 2004-029528 | | 1/2004 |
| JP | 2004-29755 | | 1/2004 |
| JP | 2004-145224 | | 5/2004 |
| JP | 2005-70227 | | 3/2005 |
| JP | 2005-157273 | | 6/2005 |
| KR | 2003-0075946 | | 9/2003 |
| KR | 10-2005-0045129 | | 5/2005 |
| KR | 10-2005-0045131 | | 5/2005 |
| KR | 10-2005-0051309 | | 6/2005 |
| KR | 10-2005-0051310 | | 6/2005 |
| KR | 10-2005-0051312 | | 6/2005 |
| WO | WO 02/39420 | A1 | 5/2002 |
| WO | WO 03/038796 | A1 | 5/2003 |
| WO | WO 03/038797 | A1 | 5/2003 |
| WO | WO 03/091980 | A1 | 11/2003 |
| WO | WO 2004/077671 | A1 | 9/2004 |

OTHER PUBLICATIONS

M. Ohta et al; "A Novel Current Programmed Pixel for Active Matrix OLED Displays"; SID 03 Digest, May 20, 2003, pp. 108-111.

European Search Report, dated Sep. 22, 2005, for Application No. 05103845.3-2205, in the name of Samsung SDI Co., Ltd.

Reporting letter, dated Nov. 4, 2005.

European Search Report dated Apr. 2, 2008, for European application 05 103 845.3, indicating relevance of reference listed in this IDS.

China Office action dated Jun. 8, 2007, for CN 200510070218.5, and English translation.

SIPO Patent Gazette, dated Oct. 8, 2008, for Chinese application 200510073819.1, noting references listed in this IDS.

U.S. Office action dated Jan. 6, 2009, for related U.S. Appl. No. 10/990,659, indicating relevance of listed reference in this IDS.

English Abstract of Chinese Patent Gazette for related China Patent 100409282C, listing China references noted in this IDS.

U.S. Notice of Allowance dated Apr. 15, 2009, for related U.S. Appl. No. 10/997,486, noting listed reference in this IDS.

English Abstract of Chinese Patent Gazette for related China Patent 100409282C, listing China references noted in this IDS, Aug. 6, 2008.

Japanese Office action dated Oct. 6, 2009, for corresponding Japanese application 2004-336903, noting listed International publication in this IDS.

U.S. Notice of Allowance dated Dec. 2, 2008, for related U.S. Appl. No. 10/997,486, noting listed reference in this IDS.

U.S. Notice of Allowance dated Jul. 9, 2009, for related U.S. Appl. No. 10/992,327, noting U.S. Patents listed in this IDS.

U.S. Office action dated Jul. 13, 2009, for related U.S. Appl. No. 10/990,659, noting U.S. Publication 2003/0030602 listed in this IDS.

Chinese Office action for corresponding China Patent Application 2005100738191, indicating relevance of CN 1447302 and JP 2004-29755 listed in this IDS, Oct. 26, 2007.

U.S. Office action dated Aug. 12, 2008, for related U.S. Appl. No. 11/112,835, indicating relevance of 8 of the listed U.S. references in this IDS.

* cited by examiner

DISPLAY DEVICE AND DEMULTIPLEXER

CROSS-REFERENCE TO RELATED APPLICATIONS

This application claims priority to and the benefit of Korean Patent Application No. 10-2004-0034560, filed May 15, 2004, in the Korean Intellectual Property Office, the entire disclosure of which is incorporated herein by reference.

BACKGROUND

1. Field of the Invention

The present invention relates to a display device and a demultiplexer, and more particularly to an organic electroluminescent display and a demultiplexer, in which a stationary pattern such as a horizontal pattern or a vertical pattern does not arise.

2. Discussion of Related Art

An organic electroluminescent display is based on a phenomenon that an exciton emits light of a specific wavelength in an organic thin film, wherein the exciton is formed by recombination of an electron and a hole injected from a cathode and an anode, respectively. The organic electroluminescent display includes a self-emitting device, unlike a liquid crystal display (LCD), so that a separate light source is not needed. In the organic electroluminescent display, the brightness of an organic electroluminescent device varies according to the quantity of current flowing through an organic light-emitting device or organic light-emitting diode (OLED).

The organic electroluminescent display can be classified as a passive matrix type or an active matrix type according to its driving method. In the case of the passive matrix type, the anode and the cathode are perpendicularly disposed and form a line to be selectively driven. The passive matrix type organic electroluminescent display can be easily realized because of its relatively simple structure, but is not suitable for realizing a large-sized screen because it consumes much more power and the time allotted to drive each light emitting device is shortened. On the other hand, in the case of the active matrix type, an active device is used to control the quantity of current flowing through the light-emitting device. As the active device, a thin film transistor (hereinafter, referred to as "TFT") is widely used. The active matrix type organic electroluminescent display has a relatively complicated structure, but it consumes relatively little power and the time allotted to drive each organic electroluminescent device is relatively longer.

Hereinbelow, a conventional organic electroluminescent display will be described with reference to FIGS. 1 and 2.

FIG. 1 is a view showing a conventional organic electroluminescent display having an active matrix of n×m pixels.

Referring to FIG. 1, a conventional organic electroluminescent display includes a panel 11, a scan driver 12, and a data driver 13. The panel 11 includes n×m pixels 14, n scan lines SCAN[1], SCAN[2], . . . , SCAN[n] formed horizontally, and m data lines DATA[1], DATA[2], . . . , DATA[m] formed vertically, where n and m are natural numbers. Here, the scan driver 12 transmits scan signals to the pixels 14 through the scan lines SCAN[1] to SCAN[n], and the data driver 23 applies data voltages to the pixels 14 through the data lines DATA[1] to DATA[m].

FIG. 2 is a circuit diagram of a pixel employed in the organic electroluminescent display of FIG. 1. In FIG. 2, DATA represents one of the data lines of FIG. 1, and SCAN represents one of the scan lines of FIG. 1.

Referring to FIG. 2, a pixel of a conventional organic electroluminescent display includes an organic light emitting device OLED, a driving transistor MD, a capacitor C, and a switching transistor MS. The driving transistor MD is connected to the organic light emitting device OLED, and supplies a current to the organic light emitting device to emit light. Further, the switching transistor MS applies a data voltage to control the quantity of current supplied by the driving transistor MD. Further, the capacitor C is connected between a source and a gate of the driving transistor MD, and maintains a voltage corresponding to the data voltage applied by the switching transistor MS for a predetermined period.

With this configuration, when a scan signal is applied to a gate of the switching transistor MS and thus the switching transistor MS is turned on, the data voltage is applied to the gate of the driving transistor MD through the data line DATA. Accordingly, as the data voltage is applied to the gate of the driving transistor MD, the driving transistor MD supplies a current to the organic light emitting device OLED, thereby allowing the organic light emitting device OLED to emit light.

At this time, the current flowing through the organic light emitting device OLED is based on the following Equation 1.

$$I_{OLED}=I_D=(\beta/2)(V_{GS}-V_{TH})^2=(\beta/2)(V_{DD}-V_{DATA}-|V_{TH}|)^2, \quad \text{[Equation 1]}$$

where $I_{OLED}$ is a current flowing through the organic light emitting device, $I_D$ is a current flowing from the source to a drain of the driving transistor MD, $V_{GS}$ is a voltage applied between the gate and the source of the driving transistor MD, $V_{TH}$ is a threshold voltage of the driving transistor MD, $V_{DD}$ is a power voltage, $V_{DATA}$ is a data voltage, and β is a gain factor.

Referring back to FIG. 1, in the conventional organic electroluminescent display, the data driver 13 is directly connected to the data lines of the pixels. Therefore, when the number of data lines is increased, the data driver 13 becomes more complicated in proportion to the number of data lines. On the other hand, even though the data driver 13 is realized as a chip separately from the panel 11, when the number of data lines is increased, the number of pins for the data driver 13 and the number of interconnection lines connecting the data driver 13 and the panel 11 should be increased in proportion to the number of data lines, thereby increasing production costs and circuit mounting space needed.

SUMMARY OF THE INVENTION

Accordingly, it is an aspect of the present invention to provide a display device and a demultiplexer, in which the demultiplexer is provided between a data driver and a panel, and a stationary pattern due to demultiplexing is reduced or eliminated. The display device, for example, can be an organic electroluminescent display.

To achieve the forgoing and/or other aspects of the present invention, in an exemplary embodiment according to the present invention, a display device including a plurality of pixels, a plurality of scan lines, a plurality of first data lines, a scan driver, a demultiplexer, and a data driver, is provided. Each pixel includes a plurality of sub-pixels. Scan signals are applied to the plurality of pixels through the plurality of scan lines. First data currents are transmitted to the plurality of pixels through the plurality of first data lines. The scan driver outputs the scan signals to the plurality of scan lines. The demultiplexer includes a plurality of demultiplexing circuits for demultiplexing second data currents into the first data currents, and for transmitting the first data currents to the plurality of first data lines. The data driver transmits the second data currents to the demultiplexer through a plurality of second data lines. At least one of the demultiplexing circuits demultiplexes a corresponding one of the second data currents transmitted from one of the second data lines into at least two of the first data currents, and transmits the at least two of the first data currents to at least two of the first data lines, wherein a number of the at least two of the first data lines is an integer multiple of a number of the sub-pixels in each of the pixels.

In another exemplary embodiment according to the present invention, a demultiplexer including a plurality of demultiplexing circuits, a plurality of sample signal lines, and first and second hold signal lines, is provided. The demultiplexing circuits transmit first data currents to a plurality of pixels, each pixel including a plurality of sub-pixels. Sampling signals are transmitted to the demultiplexing circuits through the sample signal lines. A number of sampling signal lines is an integer multiple of a number of the sub-pixels in each of the pixels. Holding signals are transmitted to the demultiplexing circuits through the first and second hold signal lines. At least one of the demultiplexing circuits demultiplexes a corresponding one of the second data currents transmitted from a second data line into at least two of the first data currents in response to the sampling and holding signals, and transmits the at least two of the first data currents to at least two first data lines. A number of the at least two first data lines is an integer multiple of a number of the sub-pixels in each of the pixels.

BRIEF DESCRIPTION OF THE DRAWINGS

These and/or other aspects of the present invention will become apparent and more readily appreciated from the following description of certain exemplary embodiments, taken in conjunction with the accompanying drawings of which.

DETAILED DESCRIPTION

Hereinafter, exemplary embodiments according to the present invention will be described in detail with reference to the accompanying drawings, wherein the display device according to the present invention is not limited to the following embodiments disclosed herein. The display device can be an organic electroluminescent display, for example.

Hereinbelow, an organic electroluminescent display according to an exemplary embodiment of the present invention will be described with reference to FIGS. 3 through 9.

Figure 1:
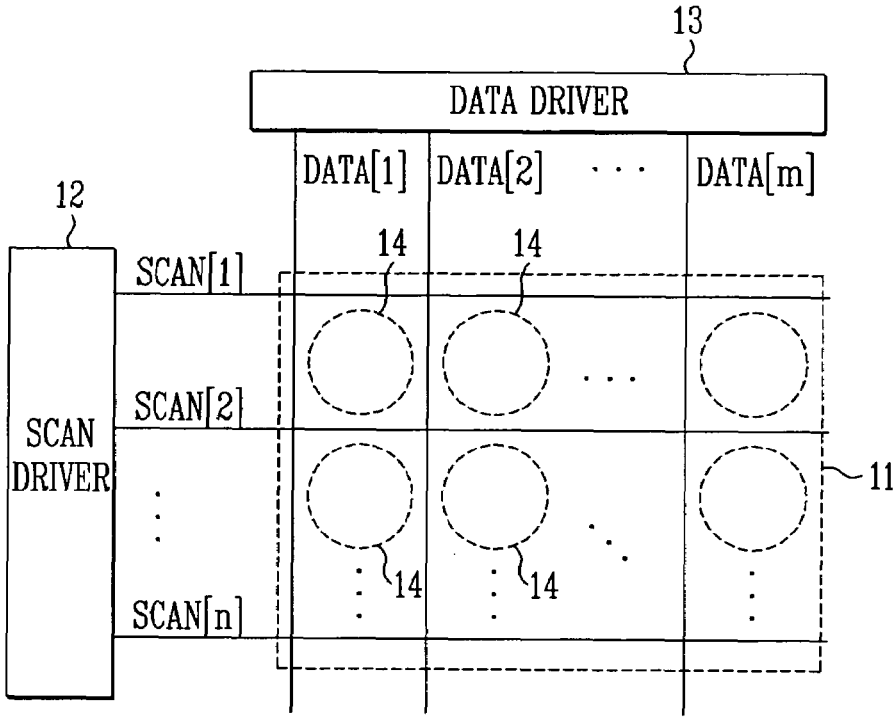
FIG.1 PRIOR ART
FIG. 1 is a view showing a conventional organic electroluminescent display having an active matrix of n×m pixels.
Figure 2:
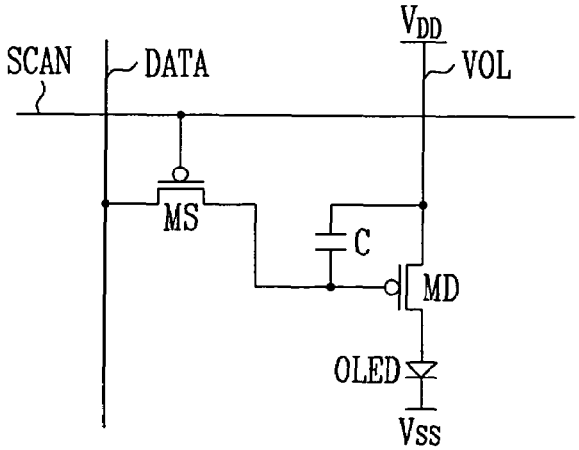
FIG.2 PRIOR ART
FIG. 2 is a circuit diagram of a pixel employed in the organic electroluminescent display of FIG. 1.
Figure 3:
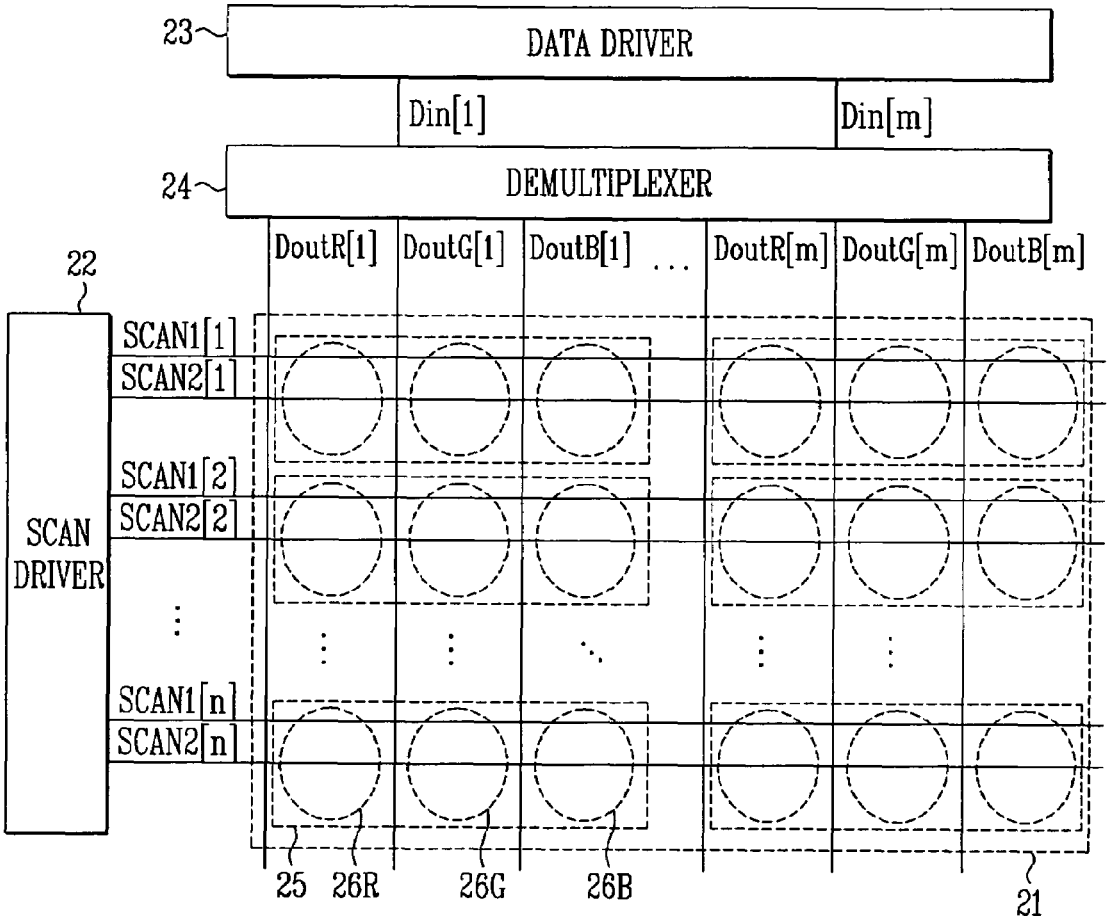
FIG. 3 is a circuit diagram of an organic electroluminescent display having an active matrix of n×m pixels according to an exemplary embodiment of the present invention.

FIG. 3 is a circuit diagram of an organic electroluminescent display having an active matrix of n×m pixels according to an exemplary embodiment of the present invention.

Referring to FIG. 3, an organic electroluminescent display according to an exemplary embodiment of the present invention includes a panel 21, a scan driver 22, a data driver 23, and a demultiplexer 24.

The panel 21 includes n×m pixels 25; n first scan lines SCAN1[1], SCAN1[2], . . . , SCAN1[n], which are horizontally formed; n second scan lines SCAN2[1], SCAN2[2], . . . , SCAN2[n], which are respectively arranged in parallel with n first scan lines; and 3 m output data lines DoutR[1], DoutG[1], DoutB[1], . . . , DoutR[m], DoutG[m], DoutB[m], where n and m are natural numbers. As an elementary unit representative of color, each pixel 25 includes three sub-pixels 26R, 26G, 26B, that is, a red sub-pixel 26R, a green sub-pixel 26G, and a blue sub-pixel 26B. The first and second scan lines SCAN1, SCAN2 (e.g., one of the first scan lines SCAN1[1]to SCAN1[n] and one of the second scan lines SCAN2[1] to SCAN2[n]) respectively transmit first and second scan signals to the pixel 25. The red, green and blue output data lines DoutR, DoutG, DoutB (e.g., one of the red output data lines DoutR[1] to DoutR[m], one of the green output data lines DoutG[1] to DoutG[m]. and one of the blue output data lines DoutB[1] to DoutB[m]) respectively transmit output data currents to the red, green, blue sub-pixels 26R, 26G, 26B. The sub-pixels 26R, 26G, 26B are operated by a current programming method. That is, a capacitor (e.g., a capacitor C' of FIG. 4) records a voltage corresponding to the current flowing in the output data lines DoutR, DoutG, DoutB for a selection period, and then a current is supplied to an organic electroluminescent display (e.g., OLED of FIG. 4) in correspondence to the voltage of the capacitor for a light emission period.

The scan driver 22 transmits the first and second scan signals to the first and second scan lines SCAN1, SCAN2.

The data driver 23 transmits input data currents to m input data lines Din[1], Din[2], . . . Din[m].

Figure 6:
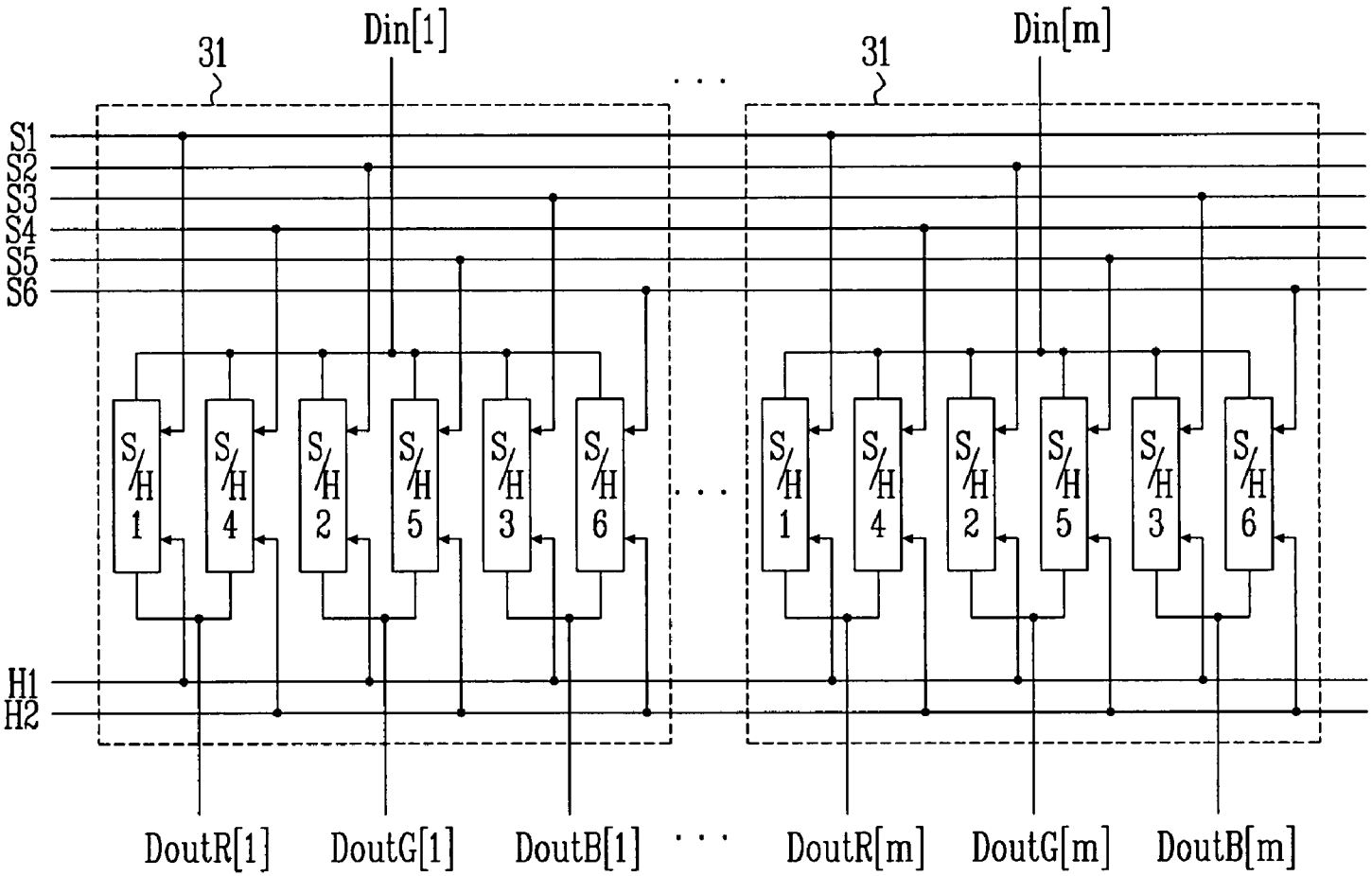
FIG. 6 is a circuit diagram of a demultiplexer according to an exemplary embodiment of the present invention, which can be employed in the organic electroluminescent display of FIG. 3.

The demultiplexer 24 receives the input data currents and demultiplexes them into output data currents, thereby transmitting the output data currents to 3 m output data lines DoutR[1], DoutG[1], DoutB[1], . . . , DoutR[m], DoutG[m], DoutB[m]. The demultiplexer 24 includes m sample/hold type demultiplexing circuits, examples of which are shown in FIG. 6. Each demultiplexing circuit is a 1:3 demultiplexing circuit, so that the input data current transmitted to one input data line Din is demultiplexed and transmitted to three output data lines DoutR, DoutG, DoutB.

Figure 4:
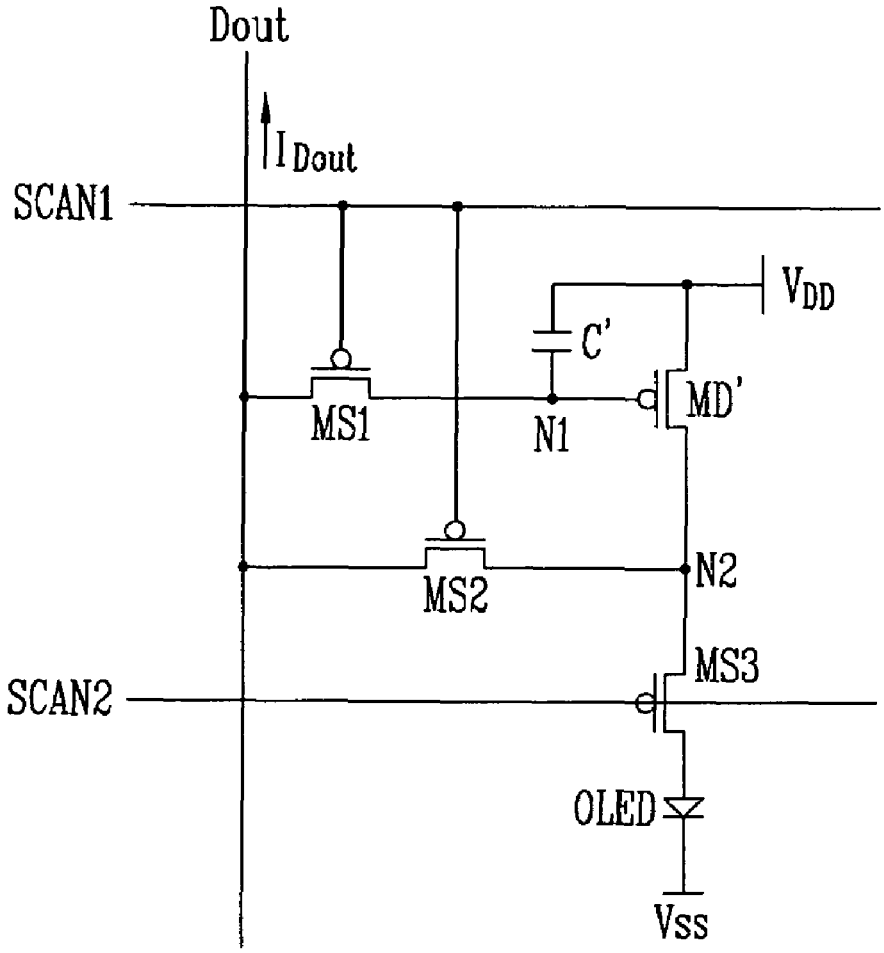
FIG. 4 is a circuit diagram of a sub-pixel employed in the organic electroluminescent display of FIG. 3.

FIG. 4 is a circuit diagram of a sub-pixel employed in the organic electroluminescent display of FIG. 3. In FIG. 4, SCAN1 represents one of the first scan lines SCAN1[1] to SCAN1[n] of FIG. 3, and SCAN2 represents one of the second scan lines SCAN2[1] to SCAN2[n]. Further, Dout represents one of the data lines DoutR[1], DoutG[1], DoutB[1], . . . , DoutR[m], DoutG[m], DoutB[m] of FIG. 3.

Referring to FIG. 4, a sub-pixel includes an organic light emitting device OLED and a sub-pixel circuit. The sub-pixel circuit includes a driving transistor MD'; first, second, third switching transistors MS1, MS2, MS3; and a capacitor C'. Each of the driving transistor MD', the first, second, and third switching transistors MS1, MS2, MS3 includes a gate, a source and a drain. The capacitor C' includes a first terminal and a second terminal.

The first switching transistor MS1 includes the gate connected to the first scan line SCAN1, the source connected to a first node N1, and the drain connected to the output data line Dout. The output data line Dout is one of the red, green and blue output data lines illustrated in FIG. 3. The first switching transistor MS1 charges the capacitor C' in response to the first scan signal of the first scan line SCAN1.

The second switching transistor MS2 includes the gate connected to the first scan line SCAN1, the source connected to a second node N2, and the drain connected to the output data line Dout. The second switching transistor MS2 transmits the output data current $I_{Dout}$ flowing in the output data line Dout to the driving transistor MD' in response to the first scan signal of the first scan line SCAN1.

The third switching transistor MS3 includes the gate connected to the second scan line SCAN2, the source connected to the second node N2, and the drain connected to the organic light emitting device OLED. The third switching transistor MS3 transmits a current flowing through the driving transistor MD' to the organic light emitting device OLED in response to the second scan signal of the second scan line SCAN2.

The capacitor C' includes the first terminal to which the power voltage $V_{DD}$ is applied, and the second terminal connected to the first node N1. While the first and second switching transistors MS1, MS2 are turned on, the capacitor C' is charged corresponding to voltage $V_{GS}$ between the gate and the source according to the output data current $I_{Dout}$ flowing in the driving transistor MD'. On the other hand, while the first and second switching transistors MS1, MS2 are turned off, the capacitor C' substantially maintains the voltage $V_{GS}$.

The driving transistor MD' includes the gate connected to the first node N1, the source to which the power voltage $V_{DD}$ is applied, and the drain connected to the second node N2. While the third switching transistor MS3 is turned on, the driving transistor MD' supplies a current to the organic light emitting device OLED, wherein the current corresponds to the voltage applied between the first and second terminals of the capacitor C'.

Figure 5:
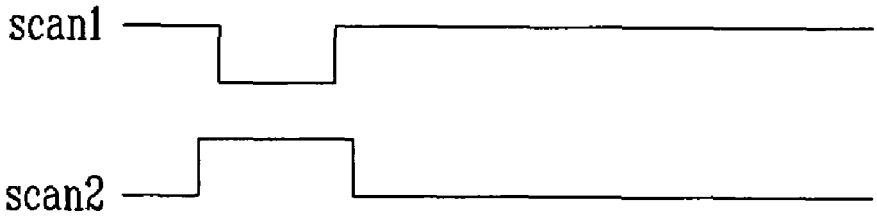
FIG. 5 is a timing diagram of signals for driving the sub-pixel of FIG. 4.

FIG. 5 is a timing diagram of signals for driving the sub-pixel of FIG. 4, wherein the signals include first and second scan signals scan1, scan 2.

Referring to FIGS. 4 and 5, operation of the sub-pixel circuit will be described hereinbelow. For the selection period when the first and second scan signal scan1, scan2 are low and high, respectively, the first and second switching transistors MS1, MS2 are turned on and the third switching transistor MS3 is turned off. For the selection period, the output data current $I_{Dout}$ flowing in the output data line Dout is transmitted to the driving transistor MD'. Here, the voltage $V_{GS}$ between the gate and the source of the driving transistor MD' is determined on the basis of the following Equation 2, and the capacitor C' is charged with the electric charge corresponding to the voltage $V_{GS}$ applied between the gate and the source thereof.

$$I_D = I_{Dout} = (\beta/2)(V_{GS} - V_{TH})^2 \quad \text{[Equation 2]}$$

For the light emission period when the first and second scan signals scan1, scan2 are high and low, respectively, the third switching transistor MS3 is turned on and the first and second switching transistors MS1, MS2 are turned off. Because the electric charge charged in the capacitor C' for the selection period is maintained for the light emission period, the voltage between the first and second terminals of the capacitor C' is determined for the selection period, that is, the voltage $V_{GS}$ between the gate and the source of the driving transistor MD' is maintained for the light emission period. Referring to Equation 2, the current $I_D$ flowing in the driving transistor MD' is determined based on the voltage $V_{GS}$ between the gate and the source, so that the output data current $I_{Dout}$ is flowing in the driving transistor MD' not only for the selection period but also for the light emission period. Therefore, the current $I_{OLED}$ flowing in the organic light-emitting device is determined on the basis of the following Equation 3.

$$I_{OLED} = I_D = I_{Dout} \quad \text{[Equation 3]}$$

Referring to Equation 3, the current $I_{OLED}$ flowing in the organic light emitting device OLED of the sub-pixel shown in FIG. 4 is equal to the output data current $I_{Dout}$, so that the current $I_{OLED}$ flowing in the organic light emitting device OLED is not affected by a threshold voltage $V_{TH}$ and a gain factor β of the driving transistor MD', thereby realizing the organic electroluminescent display improved in uniformity of brightness.

FIG. 6 is a circuit diagram of a demultiplexer according to an exemplary embodiment of the present invention, which can be employed in the organic electroluminescent display of FIG. 3, for example.

Referring to FIG. 6, the demultiplexer includes m demultiplexing circuits 31. Each demultiplexing circuit 31 includes a sample/hold type 1:3 demultiplexing circuit 31, so that the input data current transmitted to one input data line Din (e.g., one of Din[1] to Din[m]) is demultiplexed and transmitted to three output data lines DoutR (e.g., one of DoutR[1] to DoutR [m]), DoutG (e.g., one of DoutG[1] to DoutG[m]), DoutB (e.g., one of DoutB[1] to DoutB[m]). Each demultiplexing circuit 31 includes first through sixth sample/hold circuits S/H1~S/H6. Here, the first through sixth sample lines S1~S6 and the first and second hold lines H1, H2 are connected to each demultiplexing circuit 31.

The first sample/hold circuit S/H1 records a voltage corresponding to a current transmitted to the input data line Din in a capacitor (e.g., a capacitor $C_{hold}$ of FIG. 9) in response to a first sampling signal of the first sample line S1, and then transmits a current corresponding to the voltage recorded in the capacitor to the red output data line DoutR in response to a first hold signal of the first hold line H1.

Figure 9:
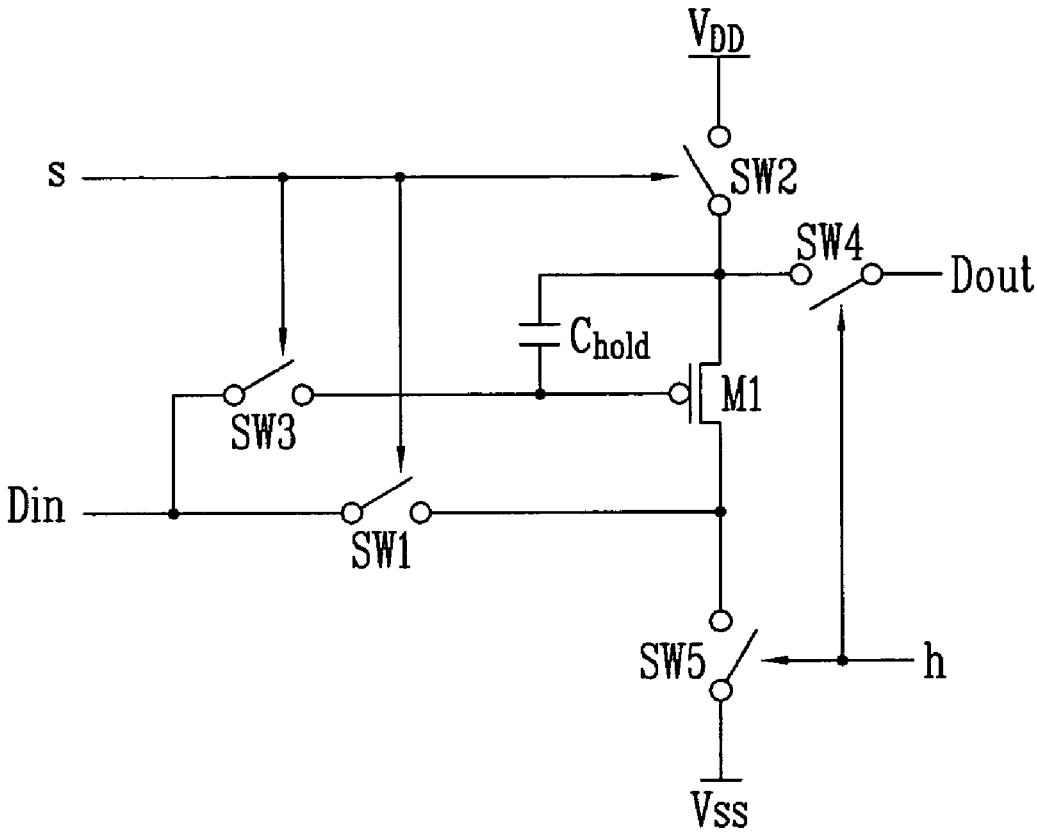
FIG. 9 is a view showing a sample/hold circuit of FIG. 6.

The second sample/hold circuit S/H2 records a voltage corresponding to a current transmitted to the input data line Din in a capacitor (e.g., as shown in FIG. 9) in response to a second sampling signal of the second sample line S2, and then transmits a current corresponding to the voltage recorded in the capacitor to the green output data line DoutG in response to the first holding signal of the first hold line H1.

The third sample/hold circuit S/H3 records a voltage corresponding to a current transmitted to the input data line Din in a capacitor (e.g., as shown in FIG. 9) in response to a third sampling signal of the third sample line S3, and then transmits a current corresponding to the voltage recorded in the capacitor to the blue output data line DoutB in response to the first holding signal of the first hold line H1.

The fourth sample/hold circuit S/H4 records a voltage corresponding to a current transmitted to the input data line Din in a capacitor (e.g., as shown in FIG. 9) in response to a fourth sampling signal of the fourth sample line S4, and then transmits a current corresponding to the voltage recorded in the capacitor to the red output data line DoutR in response to a second holding signal of the second hold line H2.

The fifth sample/hold circuit S/H5 records a voltage corresponding to a current transmitted to the input data line Din in a capacitor (e.g., as shown in FIG. 9) in response to a fifth sampling signal of the fifth sample line S5, and then transmits a current corresponding to the voltage recorded in the capacitor to the green output data line DoutG in response to the second holding signal of the second hold line H2.

The sixth sample/hold circuit S/H6 records a voltage corresponding to a current transmitted to the input data line Din in a capacitor (e.g., as shown in FIG. 9) in response to a sixth sampling signal of the sixth sample line S6, and then transmits a current corresponding to the voltage recorded in the capacitor to the blue output data line DoutB in response to the second holding signal of the second hold line H2.

Figure 7:
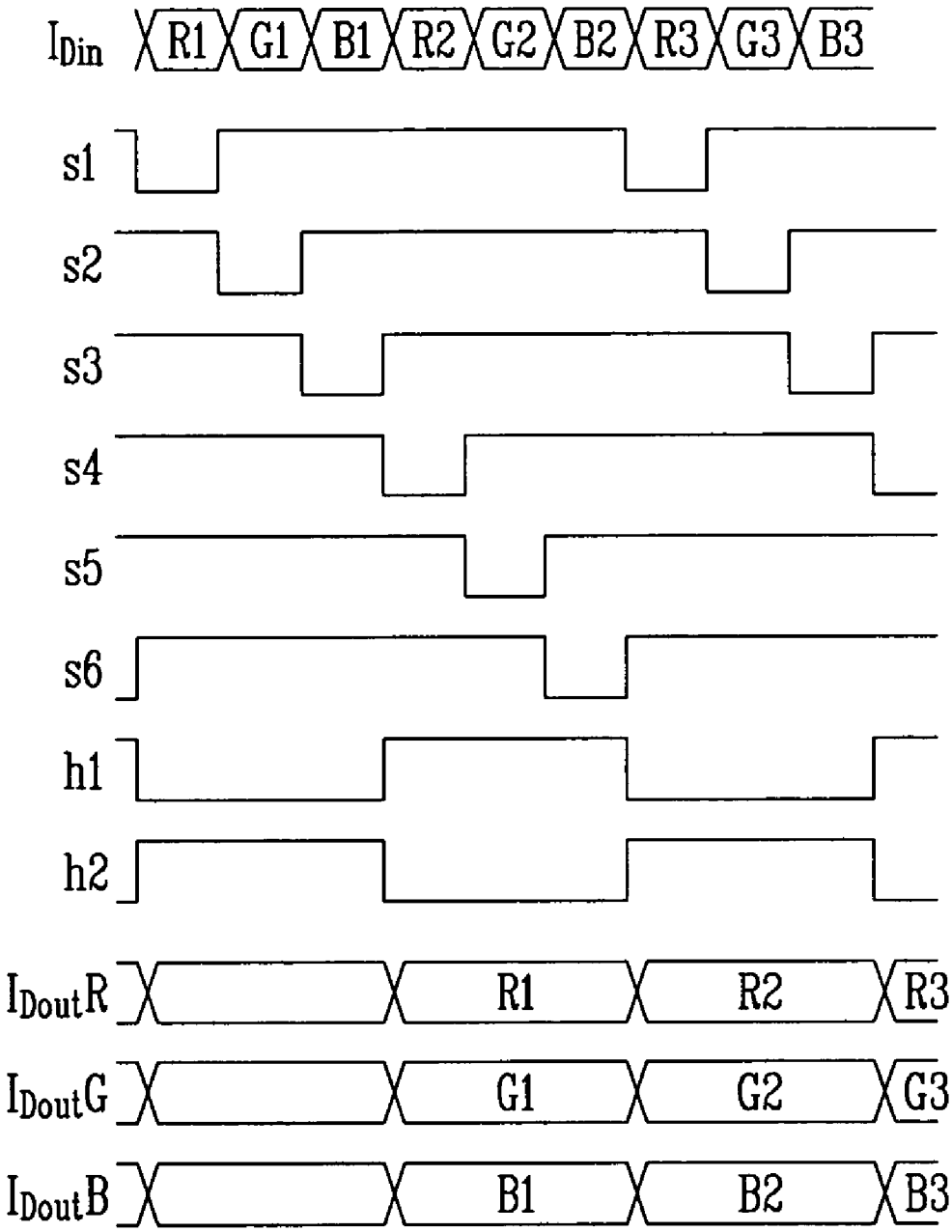
FIG. 7 is a timing diagram of input and output signals of the demultiplexer of FIG. 6.

FIG. 7 is a timing diagram of input and output signals of the demultiplexer of FIG. 6.

In more detail, FIG. 7 illustrates an input data current $I_{Din}$; first through sixth sampling signals s1, s2, . . . , s6; first and second holding signals h1, h2; and red, green, blue output data currents $I_{Dout}R$, $I_{Dout}G$, $I_{Dout}B$.

Referring to FIGS. 6 and 7, the demultiplexing circuit 31 operates as follows. Since each of the demultiplexing circuits 31 operates in substantially the same manner, the description of operation will be given below in reference to the demultiplexing circuit 31 connected to the output data lines DoutR[1], DoutG[1] and DoutB[1] only.

For a period when the first sampling signal s1 is low, a current R1 of the input data current $I_{Din}$ is sampled and stored in the first sample/hold circuit S/H1. For a period when the second sampling signal s2 is low, a current G1 of the input data current $I_{Din}$ is sampled and stored in the second sample/hold circuit S/H2. For a period when the third sampling signal s3 is low, a current B1 of the input data current $I_{Din}$ is sampled and stored in the third sample/hold circuit S/H3.

Then, for a period when the fourth sampling signal s4 is low, a current R2 of the input data current $I_{Din}$ is sampled and stored in the fourth sample/hold circuit S/H4. For a period when the fifth sampling signal s5 is low, a current G2 of the input data current $I_{Din}$ is sampled and stored in the fifth sample/hold circuit S/H5. For a period when the sixth sampling signal s6 is low, a current B2 of the input data current $I_{Din}$ is sampled and stored in the fourth sample/hold circuit S/H6. In these periods, the first holding signal h1 is high, so that the first through third sample/hold circuits S/H1, S/H2, SH3 receive the first holding signal h1 and supply currents corresponding to the sampled currents R1, G1, B1 to the output data lines DoutR[1], DoutG[1], DoutB [1], respectively.

Then, for a period when the first sampling signal s1 is low, a current R3 of the input data current $I_{Din}$ is sampled and stored in the first sample/hold circuit S/H1. For a period when the second sampling signal s2 is low, a current G3 of the input data current $I_{Din}$ is sampled and stored in the second sample/hold circuit S/H2. For a period when the third sampling signal s3 is low, a current B3 of the input data current $I_{Din}$ is sampled and stored in the third sample/hold circuit S/H3. In these periods of time, the second holding signal h2 is high, so that the fourth through sixth sample/hold circuits S/H4, S/H5, SH6 receive the second holding signal h2 and supply currents corresponding to the sampled currents R2, G2, B2 to the output data lines DoutR[1], DoutG[1], DoutB [1], respectively.

As described above, the sample/hold type demultiplexing circuit 31 demultiplexes the current inputted to the input data line Din[1] and transmits them to the output data lines DoutR[1], DoutG[1], DoutB [1].

It should be noted that the first through third sample/hold circuits S/H1, S/H2, S/H3 included in the demultiplexing circuit 31 may receive and sample the input data current $I_{Din}$ having the same magnitude and output output data currents $I_{Dout}R$, $I_{Dout}G$, $I_{Dout}B$ that are different from each other. The reason for this is as follows. The first sample/hold circuit S/H1 outputs the output data currents $I_{Dout}R$ after a lapse of a predetermined period after the input data current $I_{Din}$ is sampled, so that the capacitor storing the voltage corresponding to the input data current $I_{Din}$ is discharged, thereby allowing the output data current $I_{Dout}R$ to be lower than the input data current $I_{Din}$. On the other hand, the third sample/hold circuit S/H3 sends the output data current $I_{Dout}B$ almost immediately after sampling the input data current $I_{Din}$, so that little electric discharge occurs in the capacitor and the third sample/hold circuit S/H3 sends the output data current $I_{Dout}B$, which is higher than that of the first sample/hold circuit S/H1 after they have received and sampled the input data current $I_{Din}$ having the same magnitude. For the same reason, the second sample/hold circuit S/H2 outputs the output data current $I_{Dout}G$, which is higher than that of the first sample/hold circuit S/H1 and lower than that of the third sample/hold circuit S/H3. In this manner, the first through third sample/hold circuits S/H1, S/H2, S/H3 can output the output data currents $I_{Dout}R$, $I_{Dout}G$, $I_{Dout}B$ that are different from each other after receiving and sampling the input data current $I_{Din}$ having the same magnitude. Likewise, the fourth through sixth sample/hold circuits S/H4, S/H5, S/H6 output the output data currents $I_{Dout}R$, $I_{Dout}G$, $I_{Dout}B$ that are different from each other after receiving the input data current $I_{Din}$ having the same magnitude. In this case, the output data currents $I_{Dout}R$, $I_{Dout}G$, $I_{Dout}B$ transmitted to the respective data lines are different from each other, so that a vertical pattern may normally develop on the panel of the organic electroluminescent display. However, according to an exemplary embodiment of the present invention, because the demultiplexing circuit 31 is a 1:3 demultiplexing circuit, the vertical pattern would typically not result. That is, the differences in the output data currents $I_{Dout}R$, $I_{Dout}G$, $I_{Dout}B$ are caused among the first through third sample/hold circuits S/H1, S/H2, S/H3 provided in the demultiplexing circuit 31, so that only a set ratio among red, green and blue is changed in color coordinates, i.e., the color just changed. Further, all demultiplexing circuits 31 of the demultiplexer have substantially the same characteristics and substantially the same change in color. Therefore, the entire panel of the organic electroluminescent display is changed in color and has little vertical pattern. The change in color can be compensated by resetting the color coordinates of the data driver, for example.

Figure 8:
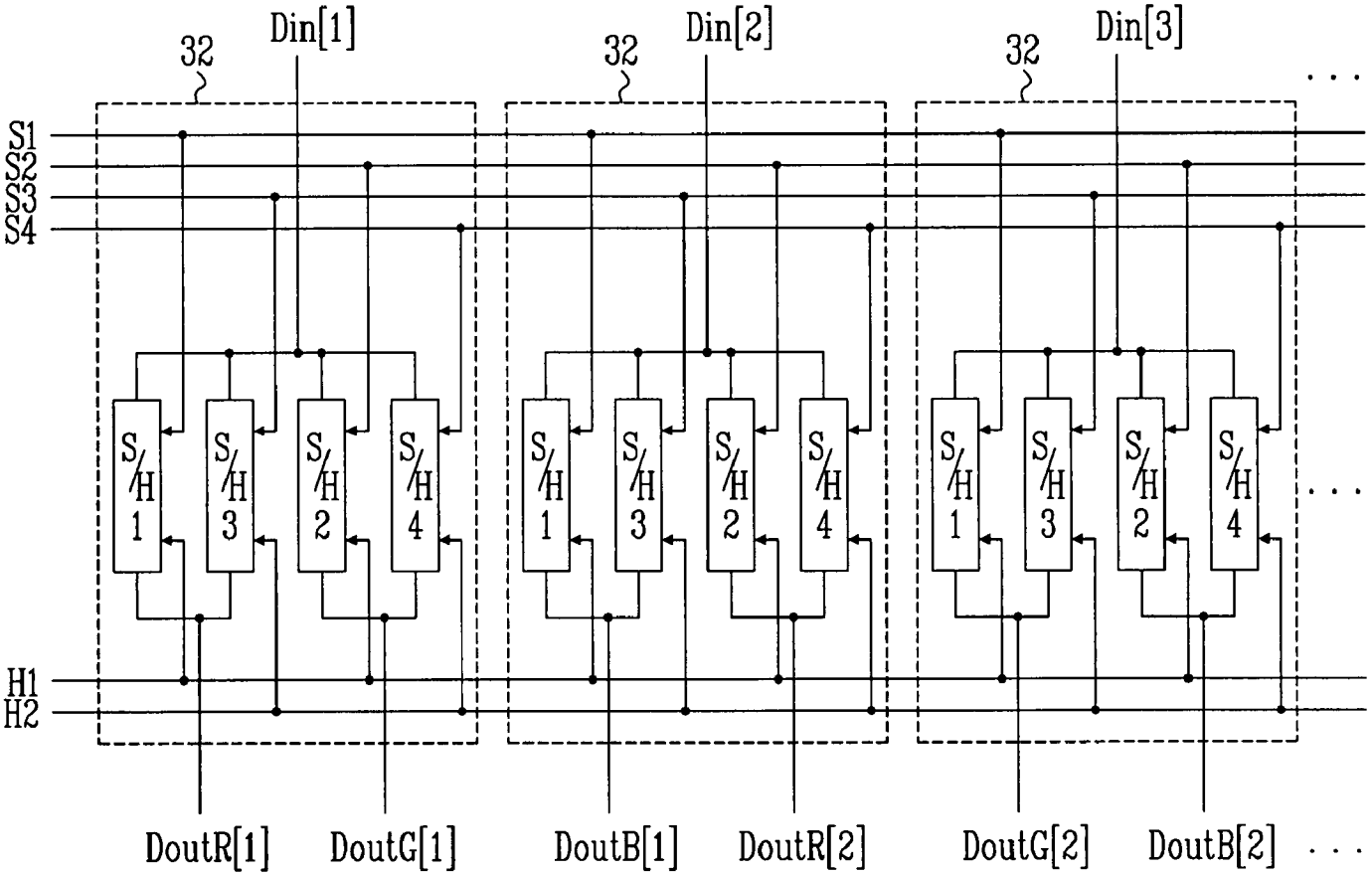
FIG. 8 is a circuit diagram of a demultiplexer using a 1:2 demultiplexing circuit.

On the other hand, a vertical pattern typically arises in the case of a 1:2 demultiplexing circuit. The reason why the vertical pattern typically arises will be described with reference to FIG. 8, which illustrates the demultiplexer including 1:2 demultiplexing circuits 32. In FIG. 8, a first red output data line DoutR[1] and a first green output data line DoutG[1] are connected to a first demultiplexing circuit. A first blue output data line DoutB[1] is connected to a second demultiplexing circuit. A second red output data line DoutR[2] is connected to the second demultiplexing circuit. A second green output data line DoutG[2] and a second blue output data line DoutB[2] are connected to a third demultiplexing circuit. In each demultiplexing circuit 32, when the first sample/hold circuit S/H1 outputs the output data current higher than that of the second sample/hold circuit S/H2 after receiving the input data current having the same magnitude, the output data current of the first green output data line DoutG[1] is lower than those of the first red and blue output data lines DoutR[1] and DoutB[1], so that the green color is relatively dark. At this time, the output data current of the second green output data line DoutG[2] is higher than those of the second red and blue output data lines DoutR[2] and DoutB[2], so that the green color is relatively bright. Therefore, the brightness difference in color causes the panel of the organic electroluminescent display to have a vertical pattern. Such a pattern arises in a 1:4 demultiplexing circuit, a 1:5 demultiplexing circuit, etc.

As described above, in the case of the 1:3 demultiplexing circuit, the whole panel of the organic electroluminescent display is changed in color, thereby having little or no vertical pattern. For the same reason, the vertical pattern does not arise in a 1:6 demultiplexing circuit, a 1:9 demultiplexing circuit, or the like. In the case where each pixel includes not three sub-pixels but four sub-pixels, e.g., a red sub-pixel, a green sub-pixel, a blue sub-pixel, and a white sub-pixel, the vertical pattern does not arise in a 1:4 demultiplexing circuit, a 1:8 demultiplexing circuit, a 1:12 demultiplexing circuit, or the like. Such a demultiplexing ratio for eliminating the vertical pattern can be generalized into the following Equation 4.

$$\text{Demultiplexing ratio}=1:k\times y \qquad \text{[Equation 4]}$$

where k is a natural number, and y is the number of sub-pixels included in each pixel. In the case where the pixel includes a red sub-pixel, a green sub-pixel and a blue sub-pixel, y is 3. In the case where the pixel includes a red sub-pixel, a green sub-pixel, a blue sub-pixel and a white sub-pixel, y is 4.

That is, the vertical pattern generally does not arise when the number of output data lines connected to each demultiplexing circuit is equal to an integer multiple of the number of sub-pixels included in each pixel, such as is the case of the demultiplexer in FIG. 6. On the other hand, a vertical pattern typically arises when the number of output data lines connected to each demultiplexing circuit is not equal to an integer multiple of the number of sub-pixels included in each pixel, such as is the case of the demultiplexer in FIG. 8.

Referring back to FIG. 6, the first and fourth sample/hold circuits S/H1, S/H4 of the demultiplexing circuit 31 can output different output data currents $I_{Dout}R$ after sampling the input data current $I_{Din}$ having the same magnitude. The cause of the different output data currents $I_{Dout}R$ is as follows. The first and the fourth sample/hold circuits S/H1 and S/H4 have different parasitic capacitor connections (i.e., different parasitic capacitance) due to difference in circuit connections or circuit layouts thereof, so that the output data currents $I_{Dout}R$ can be different from each other after sampling the input data current $I_{Din}$ having the same magnitude. For the same reason, the second and fifth sample/hold circuits S/H2, S/H5 can output different output data currents $I_{Dout}G$ after sampling the input data current $I_{Din}$ having the same magnitude. Likewise, the third and the sixth sample/hold circuits S/H3, S/H6 can output different output data currents $I_{Dout}B$ after sampling the input data current $I_{Din}$ having the same magnitude. Accordingly, a horizontal pattern may arise or develop on the panel of the organic electroluminescent display. That is, when the first sample/hold circuit S/H1 outputs the output data current $I_{Dout}R$ higher than that of the fourth sample/hold circuit S/H4, the odd numbered lines of a frame has relatively high brightness, but even numbered lines of the frame has relatively low brightness, so that the horizontal pattern may arise on the panel.

Such a horizontal pattern can be reduced or eliminated as follows. In a first frame, the first sample/hold circuit S/H1 outputs the output data current $I_{Dout}R$ to the odd numbered lines, and the fourth sample/hold circuit S/H4 outputs the output data current $I_{Dout}R$ to the even numbered lines. In a second frame, the first sample/hold circuit S/H1 outputs the output data current $I_{Dout}R$ to the even numbered lines, and the fourth sample/hold circuit S/H4 outputs the output data current $I_{Dout}R$ to the odd numbered lines. Thus, the foregoing operations are repeated every two frames, so that substantially the same output data current $I_{Dout}R$ on the average is transmitted to the odd numbered lines and the even numbered lines, thereby substantially uniformizing brightness. Of course, the principle of applying output currents from the first and fourth sample/hold circuits S/H1, S/H4 alternately to even and odd lines in successive frames can also be applied to the second and fifth sample/hold circuits S/H2, S/H5, and the third and sixth sample/hold circuits S/H3, S/H6.

FIG. 9 is a view showing one of the sample/hold circuits 31 of FIG. 6. The sample/hold circuits can have other configurations in other embodiments.

Referring to FIG. 9, a sample/hold circuit includes first through fifth switches SW1, SW2, . . . , SW5; a first transistor M1; and a hold capacitor $C_{hold}$.

The first switch SW1 electrically connects an input data line Din with a drain of the first transistor M1 in response to a sampling signal s. The second switch SW2 electrically connects a source of the first transistor M1 with a high voltage line $V_{DD}$ in response to the sampling signal s. The third switch SW3 electrically connects the input data line Din with a second terminal of the hold capacitor $C_{hold}$ in response to the sampling signal s. The fourth switch SW4 electrically connects an output data line Dout with the source of the first transistor M1 in response to a holding signal h. The fifth switch SW5 electrically connects the drain of the first transistor M1 with a low voltage line $V_{SS}$ in response to the holding signal h. The hold capacitor $C_{hold}$ has a first terminal connected to the source of the first transistor M1, and the second terminal connected to a gate of the first transistor M1.

For a sampling period when the first through third switches SW1, SW2, SW3 are turned on in response to the sampling signal s and the fourth and fifth switches SW4, SW5 are tuned off in response to the holding signal h, a current path from the high voltage line $V_{DD}$ to the input data line Din via the first transistor M1 is formed, thereby allowing the input data current $I_{Din}$ to be transmitted from the input data line Din to the first transistor M1. Thus, the hold capacitor $C_{hold}$ is charged with a voltage corresponding to the input data current $I_{Din}$ flowing to the first transistor M1.

Then, for a holding period when the first through third switches SW1, SW2, SW3 are turned off in response to the sampling signal s and the fourth and fifth switches SW4, SW5 are tuned on in response to the holding signal h, a current path from the data output line Dout to the low voltage line $V_{SS}$ via the first transistor M1 is formed, thereby allowing the current corresponding to the voltage charged in the hold capacitor $C_{hold}$, i.e., the current equivalent to the input data current $I_{Din}$, to be transmitted to the output data line Dout.

As described above, the sample/hold circuit allows the hold capacitor $C_{hold}$ to record a voltage corresponding to the input data current $I_{Din}$ in response to the sampling signal s, and transmits the current corresponding to the voltage recorded in the hold capacitor $C_{hold}$ to the output data line in response to the holding signal h. An output terminal of the data driver should be a current sink type where an external current is flown into the data driver through the output terminal. The data driver having a current sink type output terminal decreases deviation in output current, requires a relatively low voltage level in its power supply, and reduces the cost of a chip for the data driver. Accordingly, the sample/hold circuit shown in FIG. 9 has a current source type input terminal adapted to the current sink type output terminal of the data driver. That is, the current flows outwardly through the input terminal of the sample/hold circuit.

As described above, the present invention provides an organic electroluminescent display and a demultiplexer, in which a data driver has a simple structure and a stationary pattern due to demultiplexing is eliminated.

Although certain exemplary embodiments of the present invention have been shown and described, it would be appreciated by those skilled in the art that changes may be made to these exemplary embodiments without departing from the spirit or scope of the invention, the scope of which is defined by the claims and their equivalents.

What is claimed is:

1. A display device comprising:

a plurality of pixels, each comprising a plurality of sub-pixels;

a plurality of scan lines through which scan signals are applied to the plurality of pixels;

a plurality of first data lines through which first data currents are transmitted to the plurality of pixels;

a scan driver for outputting the scan signals to the plurality of scan lines;

a demultiplexer comprising a plurality of demultiplexing circuits for demultiplexing second data currents into the first data currents, and for transmitting the first data currents to the plurality of first data lines; and a data driver for transmitting the second data currents to the demultiplexer through a plurality of second data lines, wherein each of the plurality of demultiplexing circuits comprises a plurality of sample/hold circuits concurrently connected to a same one of the plurality of second data lines, the plurality of sample/hold circuits of each demultiplexing circuit for demultiplexing a corresponding one of the second data currents transmitted from the corresponding same one of the plurality of second data lines into at least two of the first data currents, and for transmitting the at least two of the first data currents to at least two of the first data lines, wherein a number of the at least two of the first data lines is an integer multiple of a number of the sub-pixels in each of the pixels.

2. The display device according to claim 1, wherein each of the pixels comprises three sub-pixels consisting of a red sub-pixel, a green sub-pixel, and a blue sub-pixel.

3. The display device according to claim 1, wherein each of the pixels comprises four sub-pixels consisting of a red sub-pixel, a green sub-pixel, a blue sub-pixel, and a white sub-pixel.

4. The display device according to claim 1, wherein the plurality of scan lines comprise a plurality of first scan lines and a plurality of second scan lines, and the scan signals comprise first scan signals and second scan signals, and wherein each of the sub-pixels comprises an organic light emitting device, first, second and third switching transistors, a driving transistor, and a capacitor.

5. The display device according to claim 4, wherein the first scan signals of the first scan lines and the second scan signals of the second scan lines include periodic signals, wherein one period of each of the first and second scan signals includes a selection period and a light emission period, wherein a corresponding one of the first scan signals turns on the first and second switching transistors during the selection period, and turns off the first and second switching transistors during the light emission period, and wherein a corresponding one of the second scan signals turns off the third switching transistor during the selection period, and turns on the third switching transistor during the light emission period.

6. The display device according to claim 4, wherein the first switching transistor charges the capacitor with electric charges in response to a corresponding one of the first scan signals, wherein the second switching transistor transmits one of the at least two of the first data currents flowing in one of the at least two of the first data lines to the driving transistor in response to the corresponding one of the first scan signals, wherein the third switching transistor transmits a current flowing in the driving transistor to the organic light emitting device in response to a corresponding one of the second scan signals, wherein the capacitor is charged with the electric charges corresponding to a voltage, which corresponds to the current flowing in the driving transistor, applied between a gate and a source of the driving transistor for a period when the first and second switching transistors are turned on, and maintains the voltage for another period when the first and second switching transistors are turned off, and wherein the driving transistor supplies the current, which corresponds to the voltage applied between first and second terminal of the capacitor, to the organic light emitting device for a period when the third switching transistor is turned on.

7. The display device according to claim 6, wherein the first scan signals of the first scan lines and the second scan signals of the second scan lines include periodic signals, and one period of each of the first and second scan signals includes a selection period and a light emission period, wherein a corresponding one of the first scan signals turns on the first and second switching transistors during the selection period, and turns off the first and second switching transistors during the light emission period, and wherein a corresponding one of the second scan signals turns off the third switching transistor during the selection period, and turns on the third switching transistor during the light emission period.

8. The display device according to claim 4, wherein the first switching transistor comprises a gate connected to a corresponding one of the first scan lines, a source connected to a first node, and a drain connected to one of the at least two of the first data lines, wherein the second switching transistor comprises a gate connected to the corresponding one of the first scan lines, a source connected to a second node, and a drain connected to the one of the at least two of the first data lines, wherein the third switching transistor comprises a gate connected to a corresponding one of the second scan lines, a source connected to the second node, and a drain connected to the organic light emitting device, wherein the capacitor comprises a first terminal to which a power voltage is applied, and a second terminal connected to the first node, and wherein the driving transistor comprises a gate connected to the first node, a source to which the power voltage is applied, and a drain connected to the second node.

9. The display device according to claim 8, wherein the first scan signals of the first scan lines and the second scan signals of the second scan lines include periodic signals, and one period of each of the first and second scan signals includes a selection period and a light emission period, wherein a corresponding one of the first scan signals turns on the first and second switching transistors during the selection period, and turns off the first and second switching transistors during the light emission period, and wherein a corresponding one of the second scan signals turns off the third switching transistor during the selection period, and turns on the third switching transistor during the light emission period.

10. The display device according to claim 1, wherein the plurality of sample/hold circuits of each demultiplexing circuit comprise first and second sample/hold circuit groups, wherein a number of the sample/hold circuits in each of the first and second sample/hold circuit groups is an integer multiple of the number of the sub-pixels in each of the pixels, and wherein the second sample/hold circuit group outputs at least one of the at least two of the first data currents corresponding to at least one previously sampled said corresponding one of the second data currents while the first sample/hold circuit group samples the corresponding one of the second data currents, and the first sample/hold circuit group outputs at least one of the at least two of the first data currents corresponding to at least another previously sampled said corresponding one of the second data currents while the second sample/hold circuit group samples the corresponding one of the second data currents.

11. The display device according to claim 10, wherein the first sample/hold circuit group alternately outputs one of the at least two of the first data currents to the pixels of odd numbered lines and even numbered lines as frames are changed, and wherein the second sample/hold circuit group alternately outputs another one of the at least two of the first data currents to the pixels of the odd numbered lines and the even numbered lines as the frames are changed.

12. The display device according to claim 10, wherein at least one of the sample/hold circuits comprises:

a first transistor having a source, a drain and a gate;

a hold capacitor having a first terminal connected to the source of the first transistor, and a second terminal connected to the gate of the first transistor;

a first switch for connecting the one of the second data lines to the drain of the first transistor in response to a sampling signal;

a second switch for connecting the source of the first transistor to a high voltage line in response to the sampling signal;

a third switch for connecting the one of the second data lines to the second terminal of the hold capacitor in response to the sampling signal;

a fourth switch for connecting one of the at least two of the first data lines to the source of the first transistor in response to a holding signal; and a fifth switch for connecting the drain of the first transistor to a low voltage line in response to the holding signal.

13. The display device according to claim 12, wherein the sampling signal and the holding signal include periodic signals, and one period of each of the sampling and holding signals includes a sampling period and a holding period, wherein the sampling signal turns on the first, second and third switches during the sampling period, and turns off the first, second and third switches during the holding period, and wherein the holding signal turns off the fourth and fifth switches during the sampling period, and turns on the fourth and fifth switches during the holding period.

14. A demultiplexer comprising:

a plurality of demultiplexing circuits for transmitting first data currents to a plurality of pixels, each pixel comprising a plurality of sub-pixels;

a plurality of sample signal lines through which sampling signals are transmitted to the demultiplexing circuits, wherein a number of sampling signal lines is an integer multiple of a number of the sub-pixels included in each of the pixels; and first and second hold signal lines through which holding signals are transmitted to the demultiplexing circuits, wherein each of the plurality of demultiplexing circuits comprises a plurality of sample/hold circuits concurrently connected to a same one of a plurality of second data lines, the plurality of sample/hold circuits of each demultiplexing circuit for demultiplexing a corresponding second data current transmitted from the corresponding same one of the plurality of second data lines into at least two of the first data currents in response to the sampling and holding signals, and for transmitting the at least two of the first data currents to at least two first data lines, wherein a number of the at least two first data lines is an integer multiple of a number of the sub-pixels in each of the pixels.

15. The demultiplexer according to claim 14, wherein each of the pixels comprises three sub-pixels consisting of a red sub-pixel, a green sub-pixel, and a blue sub-pixel.

16. The demultiplexer according to claim 14, wherein each of the pixels comprises four sub-pixels consisting of a red sub-pixel, a green sub-pixel, a blue sub-pixel, and a white sub-pixel.

17. The demultiplexer according to claim 14, wherein the plurality of sample/hold circuits of each demultiplexing circuit comprise first and second sample/hold circuit groups, wherein a number of the sample/hold circuits in each of the first and second sample/hold circuit groups is an integer multiple of the number of the sub-pixels in each of the pixels, and wherein the second sample/hold circuit group outputs at least one of the at least two of the first data currents corresponding to at least one previously sampled said corresponding one of the second data currents while the first sample/hold circuit group samples the corresponding one of the second data currents, and the first sample/hold circuit group outputs at least one of the at least two of the first data currents corresponding to at least another previously sampled said corresponding one of the second data currents while the second sample/hold circuit group samples the corresponding one of the second data currents.

18. The demultiplexer according to claim 17, wherein at least one of the sample/hold circuits comprises:

a first transistor having a source, a drain and a gate;

a hold capacitor having a first terminal connected to the source of the first transistor, and a second terminal connected to the gate of the first transistor;

a first switch for connecting the second data line to the drain of the first transistor in response to a corresponding one of the sampling signals;

a second switch for connecting the source of the first transistor to a high voltage line in response to the corresponding one of the sampling signals;

a third switch for connecting the second data line to the second terminal of the hold capacitor in response to the corresponding one of the sampling signals;

a fourth switch for connecting one of the at least two of the first data lines to the source of the first transistor in response to a corresponding one of the holding signals; and a fifth switch for connecting the drain of the first transistor to a low voltage line in response to the corresponding one of the holding signals.

19. The demultiplexer according to claim 18, wherein the sampling signals and the holding signals each include periodic signals, and one period of each of the sampling and holding signals includes a sampling period and a holding period;

wherein the sampling signal turns on the first, second and third switches during the sampling period, and turns off the first, second and third switches during the holding period; and wherein the holding signal turns off the fourth and fifth switches during the sampling period, and turns on the fourth and fifth switches during the holding period.

* * * * *

UNITED STATES PATENT AND TRADEMARK OFFICE

CERTIFICATE OF CORRECTION

PATENT NO. : 7,692,673 B2
APPLICATION NO. : 11/124926
DATED : April 6, 2010
INVENTOR(S) : Dong-Yong Shin It is certified that error appears in the above-identified patent and that said Letters Patent is hereby corrected as shown below:

In the Claims:

| | |
|---|---|
| Column 12, Claim 6, line 15 | Delete "terminal"<br>Insert -- terminals -- |

Signed and Sealed this
Twenty-eighth Day of February, 2012

David J. Kappos

David J. Kappos
*Director of the United States Patent and Trademark Office*